US008650810B1

(12) United States Patent
Dalton

(10) Patent No.: US 8,650,810 B1
(45) Date of Patent: Feb. 18, 2014

(54) WATER DIVERTER AND RELATED METHODS

(76) Inventor: Michael T. Dalton, St. Augustine, FL (US)

( * ) Notice: Subject to any disclaimer, the term of this patent is extended or adjusted under 35 U.S.C. 154(b) by 0 days.

(21) Appl. No.: 13/211,816

(22) Filed: Aug. 17, 2011

Related U.S. Application Data

(60) Provisional application No. 61/374,864, filed on Aug. 18, 2010.

(51) Int. Cl.
*E04D 13/00* (2006.01)
*E04D 15/00* (2006.01)

(52) U.S. Cl.
USPC ..... 52/97; 52/11; 52/62; 52/302.6; 49/408

(58) Field of Classification Search
USPC ..... 52/97, 11, 15, 58, 62, 73, 302.6, 741.1; 49/408
See application file for complete search history.

(56) References Cited

U.S. PATENT DOCUMENTS

| | | | | |
|---|---|---|---|---|
| 1,044,886 | A | 11/1912 | Hines | |
| 2,714,525 | A | 8/1955 | Kessler | |
| 5,581,970 | A | 12/1996 | O'Shea | |
| 5,586,415 | A | 12/1996 | Fisher et al. | |
| 5,653,068 | A | 8/1997 | Moody et al. | |
| 5,658,092 | A * | 8/1997 | Sweers | 405/118 |
| 6,092,339 | A * | 7/2000 | Hall et al. | 52/11 |
| 6,276,099 | B1 | 8/2001 | O'Shea | |
| 6,932,310 | B1 * | 8/2005 | Diss | 248/301 |
| 6,976,338 | B2 | 12/2005 | Olk et al. | |
| 7,287,354 | B2 * | 10/2007 | Rivers et al. | 52/220.1 |
| 7,676,996 | B2 | 3/2010 | Teodorovich | |
| 7,770,854 | B2 | 8/2010 | Bonshor | |
| 7,797,884 | B2 | 9/2010 | Allen | |
| 7,823,853 | B2 * | 11/2010 | Larson et al. | 248/339 |
| 2004/0163330 | A1 | 8/2004 | Crum | |
| 2005/0144865 | A1 * | 7/2005 | Ellingson | 52/272 |
| 2007/0068092 | A1 | 3/2007 | Fraser, Jr. | |
| 2008/0178557 | A1 * | 7/2008 | Parsons et al. | 52/741.1 |
| 2009/0064599 | A1 * | 3/2009 | Bennett | 52/60 |

* cited by examiner

*Primary Examiner* — Brian Glessner
*Assistant Examiner* — Brian D Mattei
(74) *Attorney, Agent, or Firm* — Allen, Dyer, Doppelt, Milbrath & Gilchrist, P.A.

(57) ABSTRACT

A water diverter for installation between siding panels of exterior siding includes a diverter body elongated in a longitudinal direction between first and second ends. The diverter body defining a channel extending in the longitudinal direction and has first and second edges extending in the longitudinal direction and defining an opening into the channel therebetween. The first and second edges can each be angled inwardly toward each to form first and second hooks, such that either one of the first and second hooks can be snap-fit into a horizontal junction between the siding panels and water flowing down the siding panel above the water diverter enters the channel through the opening and exits through at least one of the first and second ends.

16 Claims, 4 Drawing Sheets

WATER DIVERTER AND RELATED METHODS

CROSS-REFERENCE TO RELATED APPLICATION

This application claims the benefit of U.S. Provisional Application Ser. No. 61/374,864, filed on Aug. 18, 2010, the contents of which are herein incorporated by reference in their entirety.

FIELD OF THE INVENTION

The present invention relates to a water diverter for installation on exterior siding to divert water around openings therethrough, and more particularly, to water diverters for use with vinyl siding.

BACKGROUND OF THE INVENTION

Since the introduction of vinyl siding, it has become a very popular and cost effective method for exterior protection and decoration for exterior building or structure walls or wall sheathings (hereinafter collectively referred to as "walls"). Typically, siding is comprised of vinyl or aluminum (hereinafter collectively referred to as "siding"), and comes in many different colors, textures, profiles and styles. The ease of installation, limited lifetime warranties available, and the convenience of this relatively maintenance-free exterior wall guard and decorator have driven demand and usage of siding year after year in both commercial and residential markets.

Although vinyl siding serves as effective and attractive wall protection, there is a significant problem with how the system deals with building elements that require openings in the wall and siding, including but not limited to openings for windows and doors (hereinafter collectively referred to as "wall openings"). To permit expansion and contraction of the siding that naturally occurs due to varying temperature and weather conditions, the siding requires space between the siding and the outer periphery of the building component installed in the wall opening (hereinafter referred to as "siding space"). This requirement prohibits the use of a caulking material to close and seal gaps between the siding and the outside perimeter of the building component in the wall opening to prevent water infiltration behind the siding. Thus, J-channels are installed around the perimeter of the wall openings to cover the siding space, and are an aesthetically, and functionally necessary component of siding installation.

However, when it rains, water cascades down the siding above the wall opening and collects in the J-channels, which are typically three-quarters (%) or one inch (1), around the perimeter of wall openings. Water then collects and drains out of the J-channels and falls through the siding space, eventually draining behind the siding through the siding space where it saturates and damages internal building components. This problem is particularly acute in vinyl siding, which expands and contracts more than other types of siding with temperature and weather fluctuations thus, requiring greater siding space.

Because the water draining from the J-channels generally has run along the outer surface of the siding prior to collecting in the J-channels, dirt, dust, and other organic matter (collectively referred to as "matter") is carried in the water flow and collects behind the siding. The matter is a food source for mold and other organisms that cause damage to building components. The larger the volume, velocity, and frequency of water, the quicker and greater the saturation of the wall, and the greater amount of matter that collects on, or even inside, the wall. This in turn damages not only the exterior wall, but also interior building components, not to mention promotes the growth of mold, increases the building's susceptibility to insect infestation, and raises indoor air quality concerns.

Due to the siding space required for expansion and contraction, water permeates behind vinyl and aluminum siding from the time it is first installed, but these leaks are mostly unnoticed until other, larger, more costly issues appear as a direct result of the continued water leakage and damage occurring each and every time it rains. This problem is greatly magnified at gable end walls and multiple story structures because of the large surface areas that collect and shed water. Walls that do not have a soffit above are also concerning because of the lack of an overhang to reduce the water volume that will cascade down the wall, where it is eventually collected by J-channels around wall openings and permitted to enter the building through the siding space. Additionally, large wall openings for over-sized windows and doors are ready sources of moisture related problems due to the water collection capacity of the over-sized length of J-channel required at the top of the wall opening, as are siding locks, where the excessive volume of water can collect and eventually flow over the top of the siding lock and then behind the siding where it saturates the wall sheathing and interior components of the wall.

While installing weather barrier material and/or flashing around wall openings prior to siding installation can alleviate some of the problems discussed herein, the frequent and large amounts of water directed behind the siding will saturate the wall sheathing and enter the wall through the many holes in the weather barrier and flashing materials that are created by the fasteners that are required to attach the siding and J-channel to the structure. Furthermore, because the fasteners are exposed to moisture with every precipitation they will eventually rust out leaving holes in the weather barrier and flashing materials permitting water to enter the wall through the fastener holes. Again, once between the wall and the siding, as well as inside the wall itself, the water causes water damage, rot, insect infestation and other moisture-caused problems that are costly to repair. The damage is typically most prevalent on the sides of the wall opening, under the J-channels around the wall opening, and the wall space located directly below the wall opening.

A method used to attempt to drain the water that migrates behind the siding are small drainage holes manufactured in the bottom edge of horizontal panel siding, which permits water to drain to the exterior of the siding. However, the large amounts of water collected by the J-channel and diverted behind the siding through the siding space can overwhelm the drainage holes, though, as the holes often cannot redistribute the water quickly enough to the outside surface of the siding. Mold, mildew and dirt can also clog the drainage holes, causing the overflow of water to overwhelm the drainage holes and wash between the siding and the wall, where it can eventually penetrate the wall itself through wall openings and fastener holes in the weather barrier and opening flashing details.

Moreover, many buildings are assembled without the installation of a weather barrier material or the recommended wall opening flashing details, which guarantees leakage and accelerates the damage caused by water permeation at wall openings. Indeed, even the most effective weather barrier material, flashing, drainage holes and installation methodology can be ineffective when subject to the large amounts of water that is collected by the J-channels and directed behind the siding through the siding space each and every time the building is subject to precipitation.

SUMMARY OF THE INVENTION

In view of the foregoing, it is an object of the present invention to provide an improved water diverter and related methods of use. According to an embodiment of the present invention, a water diverter for installation between siding panels of exterior siding includes a diverter body elongated in a longitudinal direction between first and second ends, the diverter body defining a channel extending in the longitudinal direction, the diverter body having first and second edges extending in the longitudinal direction and defining an opening into the channel therebetween, at least the first edge being adapted for retention in a horizontal junction between the siding panels such that water flowing down the siding panel above the water diverter enters the channel through the opening and exits through at least one of the first and second ends.

According to an aspect of the present invention, the first and second edges are each angled inwardly toward each to form first and second hooks, such that either one of the first and second hooks can be snap-fit into a horizontal junction between the siding panels and water flowing down the siding panel above the water diverter enters the channel through the opening and exits through at least one of the first and second ends. To allow the water diverter to be accommodated between a wider range of siding panel types, the first and second hooks can be differently dimensioned, with the first hook extending further inwardly than the second hook.

According to a method aspect, the water diverter is installed by inserting the longitudinally extending edge into the horizontal junction between the siding panels. The horizontal junction can be a buttlock between the siding panels.

These and other objects, aspects and advantages of the present invention will be better appreciated in view of the drawings and following detailed description of a preferred embodiment.

DETAILED DESCRIPTION OF A PREFERRED EMBODIMENT

Figure 1:
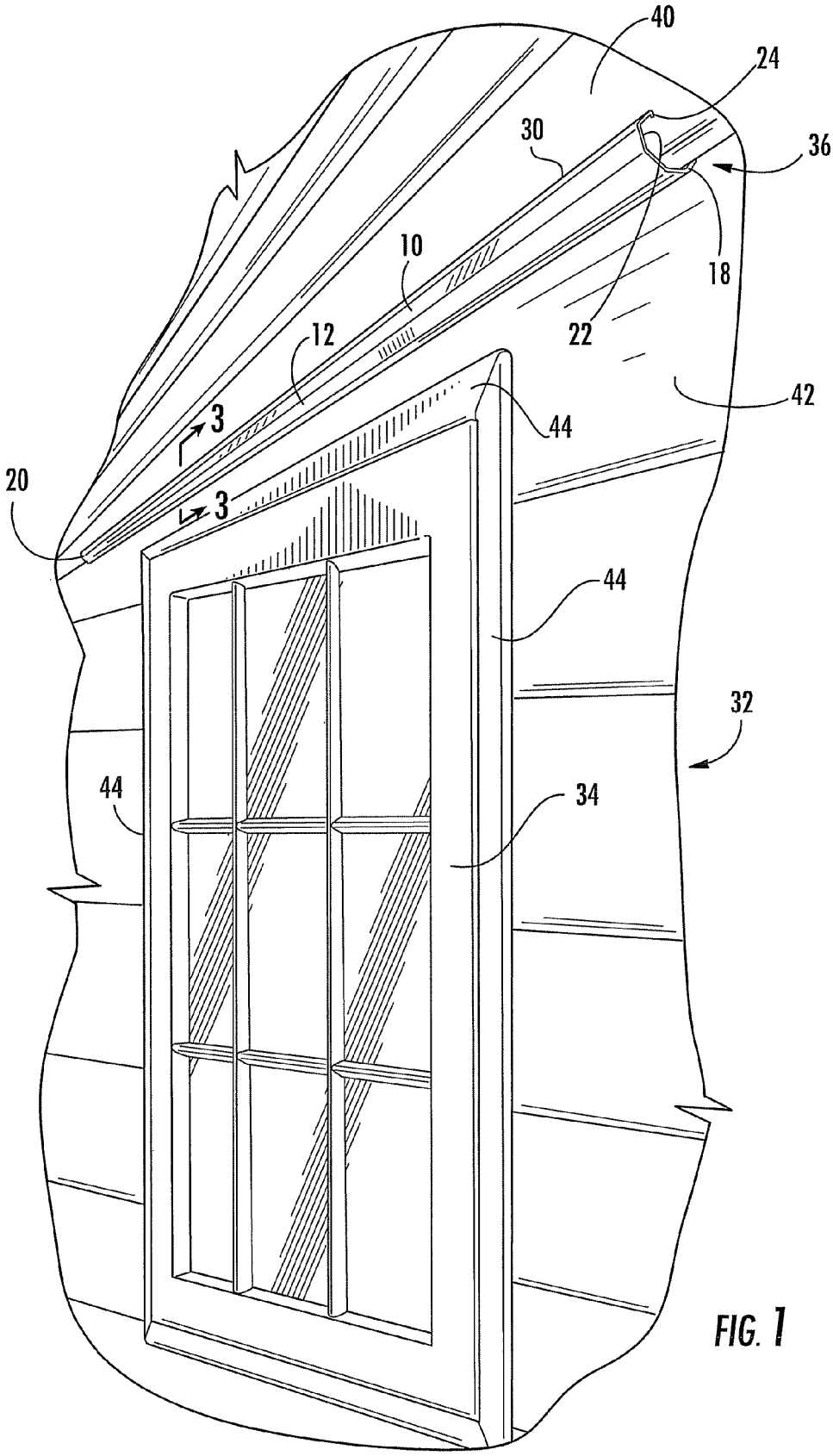
FIG. 1 is a perspective view of a water diverter according to an embodiment of the present invention, installed between siding panels over a siding opening.
Figure 2:
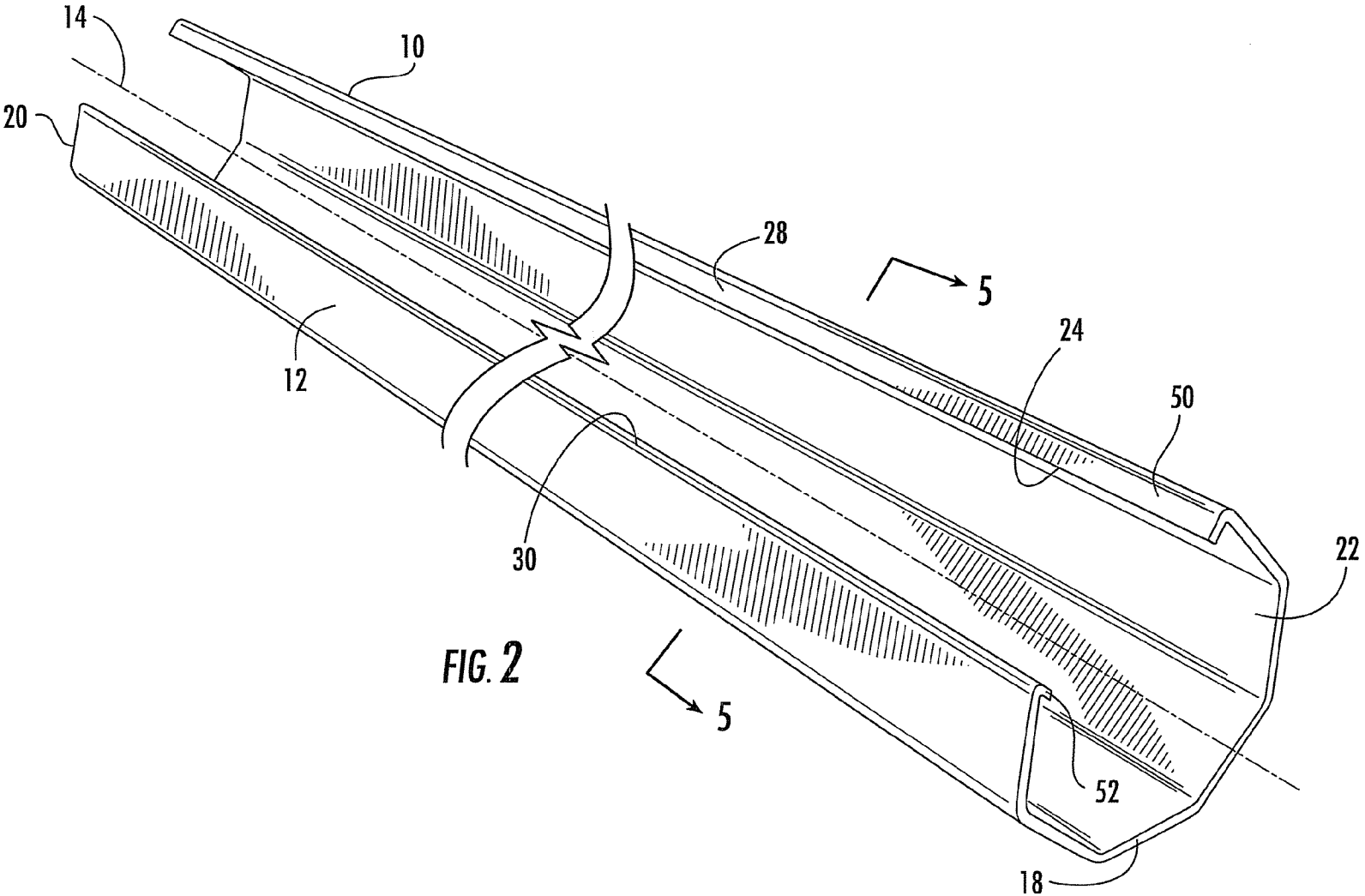
FIG. 2 is a perspective view of the water diverter of FIG. 1, uninstalled.

Referring to FIGS. 1 and 2, according to an embodiment of the present invention, a water diverter 10 includes a diverter body 12 elongated in a longitudinal direction 14 between first and second ends 18, 20. The diverter body 12 defines a longitudinally extending channel 22 therein between the first and second ends, 18, 20. An opening 24 into the channel 22 is defined between first and second longitudinally-extending edges 28, 30.

The water diverter 10 is installed on exterior siding 32 above an opening 34 therethrough, such as a window or door opening. The diverter 10 is installed by inserting one of the edges 28, 30 (the first edge 28 is inserted in FIG. 1) into a horizontal junction 36 between siding panels 40, 42, such as a buttlock between vinyl siding panels. When installed, water flowing down the siding 32 above the diverter 10 enters the channel 22 through the opening 24 and exits through one or both ends 18, 20. The water is safely diverted away from the opening 34 in the siding 32 and its associated J-channels 44, thereby avoiding the issues associated with water infiltration behind the siding 32.

Advantageously, the first and second edges 28, 30 of the diverter body 20 are angled inwardly towards each other to form generally opposed first and second hooks 50, 52 that extend along the opening 24. The first hook 50 preferably extends inwardly farther than the second hook 52. The use of differently dimensioned hooks 50, 52 allows the water diverter 10 to be securely accommodated between a wider range of panel types.

Figure 3:
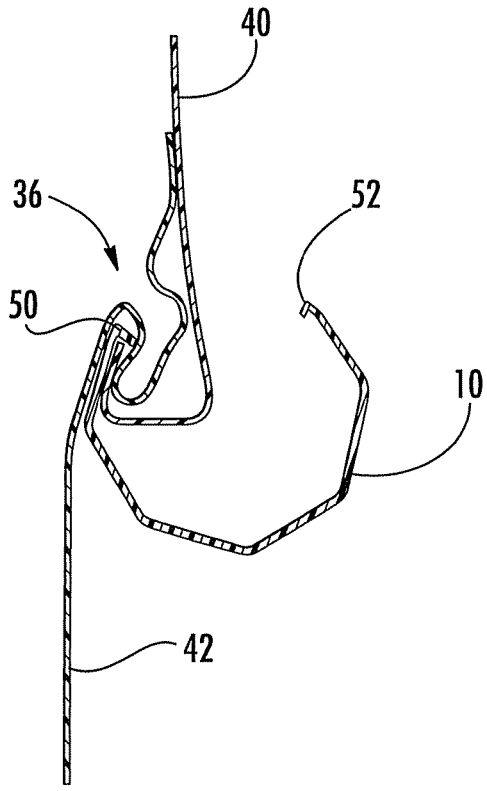
FIG. 3 is a sectional view taken along line 3-3 of FIG. 1.
Figure 4:
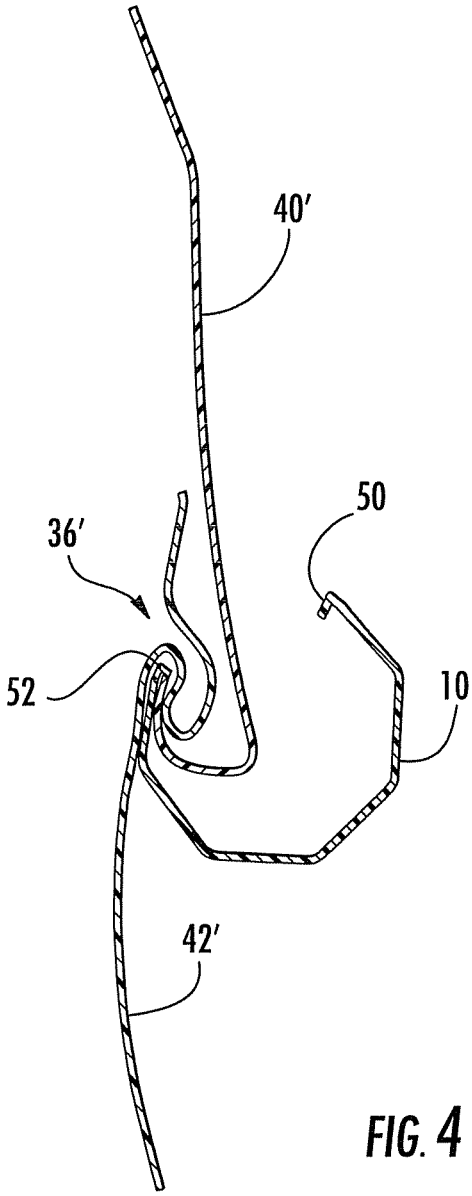
FIG. 4 is an alternate sectional view of the water diverter of FIG. 1, installed between different siding panels.

For example, referring to FIG. 3, the water diverter 10 is shown with the longer first hook 50 snap-fit into the buttlock junction 36 between the siding panels 40, 42. Referring to FIG. 4, an alternate pair of siding panels 40', 42' have less space available in their buttlock junction 36'. The water diverter 10 is securely snap-fit into the buttlock junction 36' using the shorter second hook 52.

Preferably, the diverter body 12 is extruded from a polymeric material in sufficient lengths that it can be cut as needed for particular siding openings. To minimize visual impact, the diverter body 12 is preferably transparent; alternately, diverter bodies in a range of colors could be made to match a range of siding colors.

Figure 5:
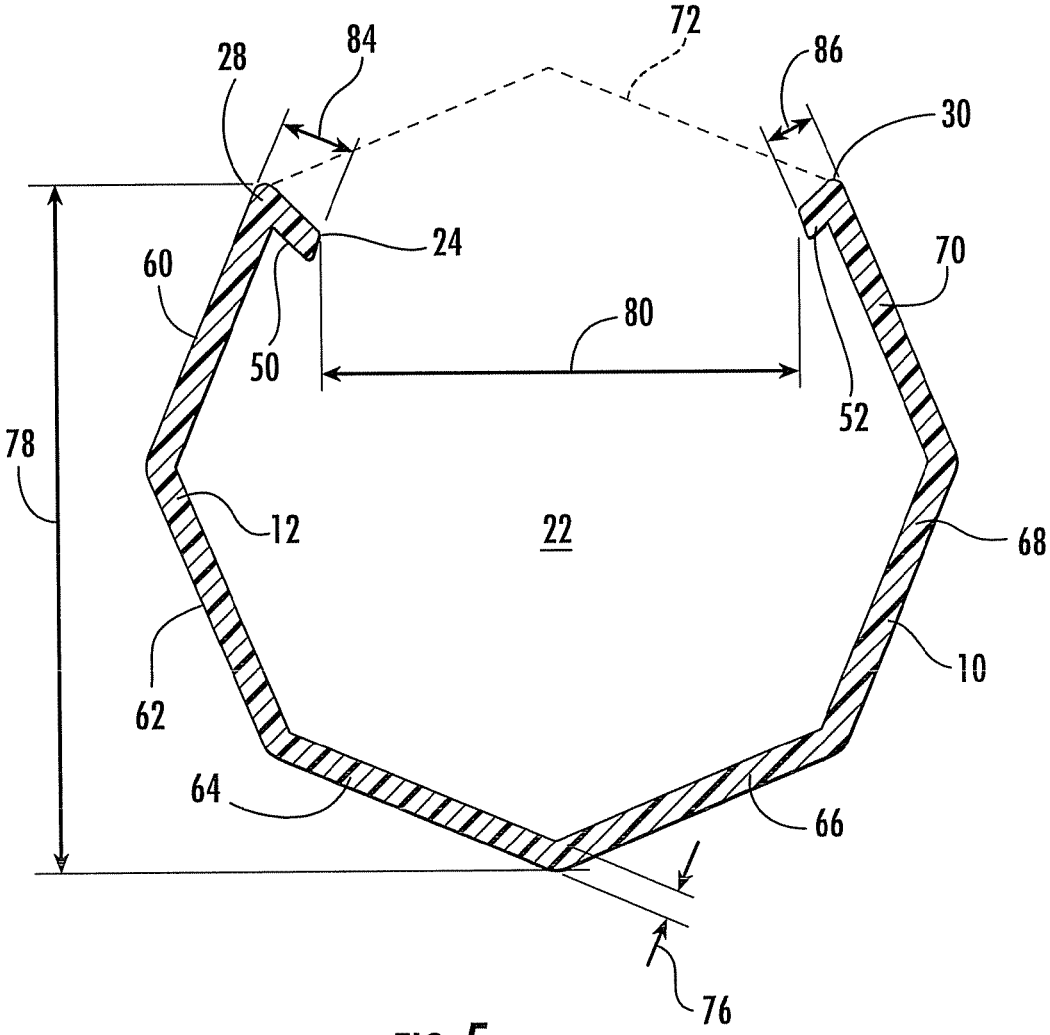
FIG. 5 is a sectional view taken along line 5-5 of FIG. 2.

Referring to FIG. 5, in a sectional plane perpendicular to the longitudinal direction 14 (see FIG. 2), the diverter body 12 is a polygon open between the first and second edges 28, 30. The polygonal section provides good rigidity to the channel 22 and helps ensure that the un-inserted one of the edges 28, 30 will remain relatively elevated and inhibit premature drainage of water before reaching the ends 18, 20 (see FIG. 2). Most preferably, the polygonal section of the diverter body defines six (6) sides 60-70, with the six sides constituting six sides of an equilateral octagon 74 (with absent sides shown in broken lines).

It will be appreciated that the particular shape and dimensions of the diverter body 12 can be varied within the scope of the present invention. However, preferred dimensions include a wall thickness 76 of approximately 0.042 inches and an overall height 78 of approximately 1.014 inches. The opening 24 preferably has a width of approximately 0.713 inches between the first and second edges 28, 30. The first hook 50 extends inwardly from its adjacent side 60 a distance 84 of approximately 0.111 inches and the second hook 52 extends inwardly from its adjacent side 70 a distance 86 of approximately 0.075 inches. The hooks 50, 52 preferably form acute angles with their respective adjacent sides 60, 70 of between approximately 65 to approximately 75 degrees.

Referring to FIG. 1-3, during installation of the water diverter 10, the width of the opening 34 in the exterior siding 32 is measured. The diverter body 12 should be cut to extend a predetermined length beyond each side of the opening 34, preferably at least approximately five (5) inches beyond each side. Advantageously, the diverter body 12 can be cut with many readily available tools, such as kitchen shears, tin snips or a hacksaw.

In addition to extending at least five (5) inches past each side of the opening 34, neither end 18, 20 of the diverter body should be within a predetermined distance of the exposed side of a vertical seam between siding panels. Preferably, if the exposed side of a vertical seam would otherwise fall within six (6) inches from an end of the diverter body 12, the diverter body 12 should be cut to extend at least three (3) inches past the vertical seam.

It should also be determined whether the first hook 50 or second hook 52 would result in a more secure fit in the horizontal junction 36. In general, the first hook 50 should be tried first, and if the first hook 50 does not readily snap-fit into the junction 36, the second hook 52 should be tried. A soap solution or other lubricant can be applied along the junction 36 to facilitate insertion, particularly for older siding that has dried out and lost flexibility. An indication that one of the hooks 50, 52 is securely snap-fit into the horizontal junction 36 is that the diverter body 12 can slide back and forth in the junction 36 without disengaging therefrom.

From the foregoing, it will be appreciated that the water diverter of the present invention presents a highly effective solution to the problem of water infiltration behind siding adjacent to openings, while still being extremely easy to manufacture and install. In particular, the diverter of the present invention can be installed in an extremely wide range of vinyl siding types with no need for separate fasteners or adhesives, and no need to remove or otherwise disturb existing siding.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A water diverter installed between siding panels of exterior siding, the water diverter comprising:

a diverter body elongated along a longitudinal direction between first and second ends, the diverter body defining a channel extending in the longitudinal direction, the diverter body having first and second edges extending in the longitudinal direction and defining an opening into the channel therebetween, one of the first and second edges being retained in a horizontal junction between the siding panels such that water flowing down the siding panel above the water diverter enters the channel through the opening and exits through at least one of the first and second ends, the other of the first and second edges being at an approximately equal height with edge retained between the siding panels;

wherein the first edge is angled inwardly toward the second edge to form a first hook extending along the opening;

wherein the second edge is also angled inwardly toward the first edge to form a second hook extending along the opening opposite the first hook; and wherein the first hook extends inwardly further than the second hook.

2. The water diverter of claim 1, wherein the first and second hooks are angled inwardly to form angles of approximately 65 to approximately 75 degrees with respective adjacent sections of the diverter body.

3. The water diverter of claim 1, wherein, in a sectional plane generally transverse to the longitudinal direction, the diverter body is generally a polygon open between the first and second edges.

4. The water diverter of claim 3, wherein the polygon includes six sides between the first and second edges.

5. The water diverter of claim 4, wherein the six sides define six sides of an equilateral octagon.

6. The water diverter of claim 1, wherein the diverter body is substantially transparent.

7. The water diverter of claim 1, wherein the diverter body is an extruded polymer.

8. A method of installing the water diverter of claim 1 in between the siding panels of the exterior siding, the method comprising:

inserting the first or second edge of the water diverter into the horizontal junction between the siding panels, such that the channel defined by the diverter body opens upwardly to collect water running down the exterior siding and drain it out the first or second end thereof.

9. The method of claim 8, wherein the horizontal junction is a buttlock between the siding panels.

10. The method of claim 9, wherein inserting the first or second edge edge of the body of the water diverter into the horizontal junction between the siding panels includes snap-fitting the first or second hook into the buttlock.

11. The method of claim 8, further comprising a preliminary step of cutting the body of the water diverter to a predetermined length to extend past opposite sides of an opening in the exterior siding over which the water diverter is then inserted.

12. The method of claim 8, further comprising a preliminary step of determining whether the longitudinally extending edge or another longitudinally extending edge fits more securely into the horizontal junction.

13. The method of claim 8, further comprising a preliminary step of lubricating the horizontal junction before inserting the longitudinally extending edge therein.

14. A water diverter installed between siding panels of exterior siding over a window or door opening, the water diverter comprising:

a diverter body elongated in a longitudinal direction between first and second ends, the diverter body defining a channel extending in the longitudinal direction, the diverter body having first and second edges extending in the longitudinal direction and defining an opening into the channel therebetween, the first and second edges each being angled inwardly toward each other to form first and second hooks, one of the first and second hooks being snap-fit into a horizontal junction between the siding panels and water flowing down the siding panel above the water diverter enters the channel through the opening into the channel and exits through at least one of the first and second ends, the first and second ends extending past respective ends of the window or door opening.

15. The water diverter of claim 14, wherein the first hook extends inwardly further than the second hook.

16. The water diverter of claim 14, wherein, in a sectional plane generally transverse to the longitudinal direction, the diverter body is generally a polygon open between the first and second edges.

* * * * *